US010008763B2

(12) United States Patent
Huang et al.

(10) Patent No.: US 10,008,763 B2
(45) Date of Patent: Jun. 26, 2018

(54) MULTI-BAND ANTENNA

(71) Applicant: PEGATRON CORPORATION, Taipei (TW)

(72) Inventors: Chin-Ting Huang, Taipei (TW); Hsiao-Wen Wu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 102 days.

(21) Appl. No.: 14/958,618

(22) Filed: Dec. 3, 2015

(65) Prior Publication Data

US 2016/0164181 A1 Jun. 9, 2016

(30) Foreign Application Priority Data

Dec. 9, 2014 (TW) ..... 103142817 A

(51) Int. Cl.

| | |
|---|---|
| ***H01Q 1/24*** | (2006.01) |
| ***H01Q 1/44*** | (2006.01) |
| ***H01Q 5/30*** | (2015.01) |
| ***H01Q 9/40*** | (2006.01) |
| ***H01Q 9/42*** | (2006.01) |
| ***H01Q 5/378*** | (2015.01) |

(52) U.S. Cl.

CPC ..... *H01Q 1/243* (2013.01); *H01Q 1/44* (2013.01); *H01Q 5/378* (2015.01); *H01Q 9/40* (2013.01); *H01Q 9/42* (2013.01)

(58) Field of Classification Search

CPC ..... H01Q 9/0407; H01Q 1/38; H01Q 1/243; H01Q 5/378; H01Q 5/357; H01Q 5/364; H01Q 5/371; H01Q 1/44

See application file for complete search history.

(56) References Cited

U.S. PATENT DOCUMENTS

| | | | | |
|---|---|---|---|---|
| 6,963,310 | B2 | 11/2005 | Horita et al. | |
| 8,421,682 | B2 * | 4/2013 | Nielsen | H01Q 1/243 343/702 |
| 2004/0198293 | A1 * | 10/2004 | Sadler | H01Q 1/243 455/280 |
| 2009/0160713 | A1 * | 6/2009 | Nielsen | H01Q 1/243 343/702 |
| 2009/0289856 | A1 * | 11/2009 | Cho | H01Q 1/243 343/702 |
| 2010/0060529 | A1 * | 3/2010 | Schlub | H01Q 1/243 343/702 |
| 2012/0299779 | A1 * | 11/2012 | Yen | H01Q 1/243 343/700 MS |

(Continued)

FOREIGN PATENT DOCUMENTS

| | | |
|---|---|---|
| CN | 103401059 | 11/2013 |
| CN | 103811863 | 5/2014 |

*Primary Examiner* — Dameon E Levi
*Assistant Examiner* — Jennifer F Hu
(74) *Attorney, Agent, or Firm* — J.C. Patents

(57) ABSTRACT

A multi-band antenna includes a conductive cap, a ground plane element, a supporting frame, a first radiating conductive element, a second radiating conductive element, a third radiating conductive element, and a plurality of conductive pieces. The multi-band antenna of the disclosure makes the radiating conductive element contact with the conductive cap physically via the conductive piece. Therefore, although a gap similar to a slot is formed, the resonant mode of the multi-band antenna is not excited via the slot.

9 Claims, 4 Drawing Sheets

(56) References Cited

U.S. PATENT DOCUMENTS

| | | | | |
|---|---|---|---|---|
| 2013/0057437 | A1* | 3/2013 | Chiu | H01Q 1/243 343/702 |
| 2014/0125528 | A1* | 5/2014 | Tsai | H01Q 1/243 343/702 |
| 2014/0292590 | A1* | 10/2014 | Yoo | H01Q 1/243 343/702 |
| 2014/0347229 | A1* | 11/2014 | Chen | H01Q 1/243 343/702 |

* cited by examiner

MULTI-BAND ANTENNA

CROSS-REFERENCE TO RELATED APPLICATION

This application claims the priority benefit of Taiwan application serial no. 103142817, filed on Dec. 9, 2014. The entirety of the above-mentioned patent application is hereby incorporated by reference herein and made a part of this specification.

BACKGROUND

Technology Field

The disclosure relates to a multi-band antenna and, in particular, to a multi-band antenna which does not use a slot to excite a resonant mode.

Related Art

Except for compactness, a modern electronic device with wireless communication capability, such as a notebook computer or a tablet computer, may adopt a metallic back cover or other aesthetics design via metallic material to attract the eyes of the consumers.

However, although more beautiful and more strengthened, a metallic back cover brings greater challenges to the antenna design in the electronic device. For example, it is always necessary to provide a no-metal area to dispose the antenna, and the size of the no-metal area must be far larger than the size of the antenna. Therefore, the combination of the metallic back cover and the antenna results in the conflict between the mechanical design, the aesthetics design and the function design of the electronic device.

SUMMARY

The disclosure provides a multi-band antenna that excites a resonant mode without using a slot.

The multi-band antenna of the disclosure includes a conductive cap, a ground plane element, a supporting frame, a first radiating conductive element, a second radiating conductive element, a third radiating conductive element, and a plurality of conductive pieces. The conductive cap has a first sub-conductive piece, a second sub-conductive piece and a conductive connecting portion connected between the first sub-conductive piece and the second sub-conductive piece, and the first sub-conductive piece is at a distance from the second sub-conductive piece to form a gap at least at one side of the conductive connecting portion. The ground plane element has a signal feed line, and is disposed between the supporting frame and the conductive cap. The first radiating conductive element, the second radiating conductive element and the third radiating conductive element are disposed at the supporting frame, and the first radiating conductive element is disposed between the second radiating conductive element and the third radiating conductive element, wherein the first radiating conductive element, the second radiating conductive element and the third radiating conductive element have electrical contacts connected with the conductive cap via one of the conductive pieces, respectively, and another electrical contact of the first radiating conductive element is connected with the signal feed line.

In one embodiment of the disclosure, the conductive cap is an outer cover of an electronic device.

In one embodiment of the disclosure, the material of the conductive cap is metal or carbon fiber.

In one embodiment of the disclosure, the supporting frame is made of non-conductive material.

In one embodiment of the disclosure, the dielectric coefficient of the supporting frame is at least different from the dielectric coefficient of one of the first radiating conductive element, the second radiating conductive element and the third radiating conductive element.

In one embodiment of the disclosure, the conductive pieces are metal spring plates.

In one embodiment of the disclosure, the second radiating conductive element and the third radiating conductive element are disposed within the orthographic projection area of the second sub-conductive piece.

In one embodiment of the disclosure, the multi-band antenna further includes a parasitic conductive element disposed on the supporting frame, and the parasitic conductive element is disposed between the second radiating conductive element and the first radiating conductive element. The ground plane element has a short conductive element, and the parasitic conductive element is connected with the short conductive element.

Based on the above, the multi-band antenna of the disclosure makes the radiating conductive element contact with the conductive cap physically via the conductive piece. Therefore, although a gap similar to a slot is formed, the resonant mode of the multi-band antenna is not excited via the slot. This not only solves the issue that the antenna signal is affected by the metallic back cover of the electronic device, but also makes the position of the conductive connecting portion be changeable in view of actual appearance design requirements.

The disclosure will become more fully understood from the detailed description and accompanying drawings, which are given for illustration only, and thus are not limitative of the present disclosure.

DETAILED DESCRIPTION OF THE EMBODIMENT

Figure 1:
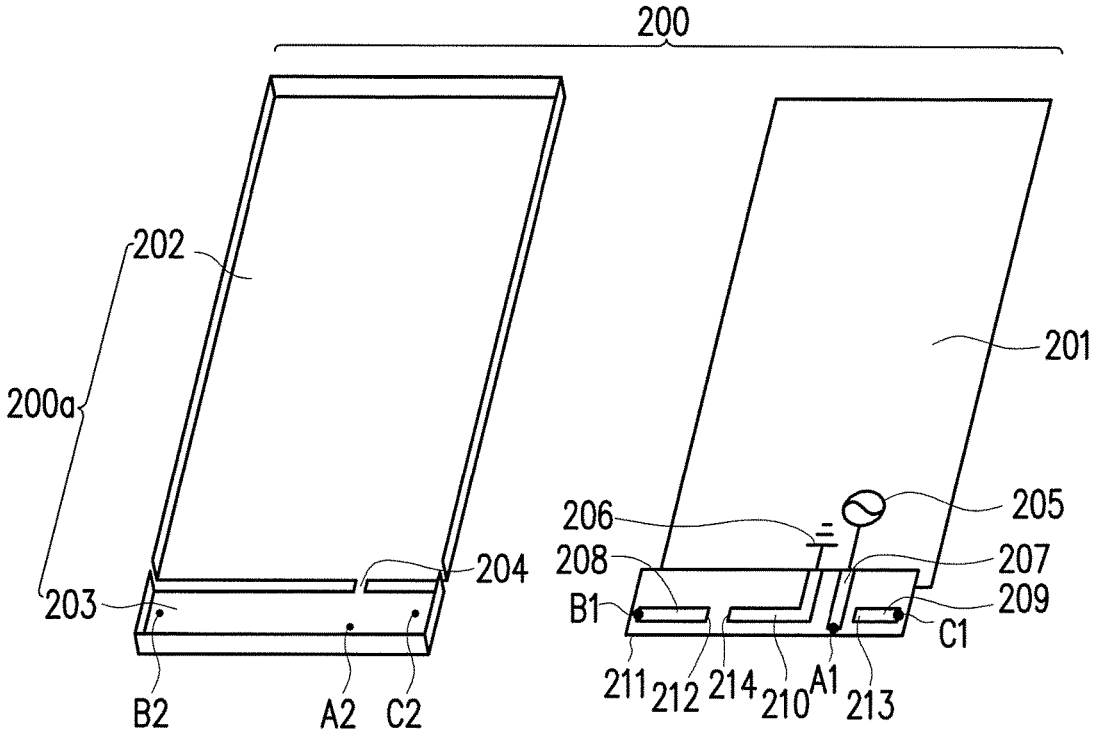
FIG. 1 is an exploded schematic diagram showing a multi-band antenna according to an embodiment of the invention.
Figure 2:
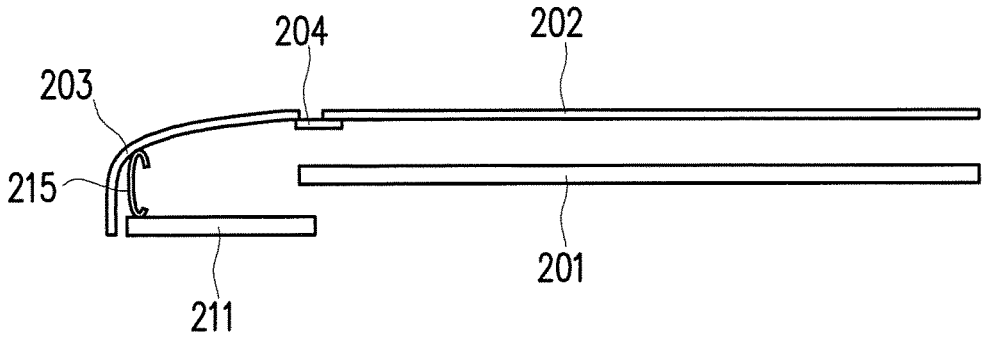
FIG. 2 is a sectional schematic diagram of the multi-band antenna shown in FIG. 1.

FIG. 1 is an exploded schematic diagram showing a multi-band antenna according to an embodiment of the invention, and FIG. 2 is a sectional schematic diagram of the multi-band antenna shown in FIG. 1. Referring to FIG. 1 and FIG. 2, the multi-band antenna 200 includes a conductive cap 200*a*, a ground plane element 201, a supporting frame 211, a first radiating conductive element 207, a second radiating conductive element 208, a third radiating conductive element 209 and a plurality of conductive pieces 215. The conductive cap 200*a* has a first sub-conductive piece 202, a second sub-conductive piece 203 and a conductive connecting portion 204 connecting the first sub-conductive piece 202 and the second sub-conductive piece 203. The first sub-conductive piece 202 is at a distance from the second sub-conductive piece 203 to form a gap at least at one side of the conductive connecting portion 204. The ground plane element 201 has a signal feed line 205, and the ground plane element 201 is disposed between the supporting frame 211 and the conductive cap 200*a*. The first radiating conductive element 207, the second radiating conductive element 208 and the third radiating conductive element 209 are all disposed at the supporting frame 211, and the first radiating conductive element 207 is disposed between the second radiating conductive element 208 and the third radiating conductive 209, wherein the electrical contacts of the first radiating conductive element 207, the second radiating conductive element 208 and the third radiating conductive element 209 are in physical contacts with the conductive cap 200*a* via different conductive pieces 215, while only another electrical contact of the first radiating conductive element 207 is connected with the signal feed line 205. In detail, the electrical contact A1 of the first radiating conductive element 207 is in physical contact with the conductive cap 200*a* via the conductive piece 215, the electrical contact B1 of the third radiating conductive element 209 is in physical contact with the conductive cap 200*a* via the conductive piece 215, and the electrical contact C1 of the radiating conductive element 209 is in physical contact with the conductive piece 215 via the conductive piece 215.

The multi-band antenna 200 of the embodiment can be implemented in an electrical device such as a cellphone or a tablet computer, and wherein the conductive cap 200*a* mentioned above is the outer cover, such as the back cover, of the electrical device. The conductive cap 200*a* may be made of electrically conductive material, such as metal or carbon fiber without limiting sense. Moreover, the supporting frame 211 of the embodiment is made of non-conductive material, or any material which has a dielectric coefficient different from the dielectric coefficient of any of the first radiating conductive element 207, the second radiating conductive element 208, the third radiating conductive element 209 and parasitic conductive element.

The conductive pieces 215 that make the electrical contacts of the first radiating conductive element 207, the second radiating conductive element 208 and the third radiating conductive element 207 be in contact with the conductive cap 200*a* may be metal spring plates without limiting sense. Persons having ordinary skill in the art can change the shapes of the conductive pieces 215 based on actual needs as long as the objective that the respective electrical contacts A1, B1 and C1 of the first radiating conductive element 207, second radiating conductive element 208 and the third radiating conductive element 209 can be in contact with the conductive cap 200*a* via the conductive pieces 215 can be achieved. Moreover, the second radiating conductive element 208 and the third radiating conductive element 209 can be correspondingly disposed within the orthographic projection area of the second sub-conductive piece 203.

Furthermore, the multi-band antenna 200 further includes a parasitic conductive element 210 disposed on the supporting frame 211 and between the second radiating conductive element 208 and the first radiating conductive element 207. The ground plane element 201 further includes a short conductive element 206, and the parasitic conductive element 210 is connected with the short conductive element 206.

The architecture of the multi-band antenna 200 can achieve the objective of multi-band operation. In detail, the multi-band antenna 200 has a first resonant mode frequency of a lower band, which is controlled by connecting the signal feed line 205 with the first radiating conductive element 207, connecting the electrical contact A1 of the first radiating conductive element 207 with the electrical contact A2 of the second sub-conductive piece 203 via the conductive piece 215, and connecting the electrical contact B2 of the sub-conductive piece 203 with the first open end 212 of the second radiating conductive element 208 via another conductive piece 215, having a length of a quarter of the wavelength. The multi-band antenna 200 also has a second resonant mode frequency of a middle band, which is controlled by connecting the signal feed line 205 with the first radiating conductive element 207, connecting the electrical contact A1 of the first radiating conductive element 207 with the electrical contact A2 of the second sub-conductive piece 203 via the conductive piece 215 which is a metal spring, and connecting the electrical contact C2 of the second sub-conductive piece 203 with the second open end 213 of the third radiating conductive element 209 via the conductive piece 215 and the electrical contact C1, having a length of a quarter of the wavelength. This multi-band antenna 200 further has a third resonant mode frequency, which is controlled by connecting the signal feed line 205 with the first radiating conductive element 207, connecting the electrical contact A1 of the first radiating conductive element 207 with the electrical contact B2 of the second sub-conductive piece 203 via the conductive piece 215, and connecting the electrical contact B2 of the sub-conductive piece 203 with the first open end 212 of the second radiating conductive element 208 via the conductive piece 215 and the electrical contact B1, having a length of one half of the wavelength. Moreover, suitable spacings exist between the parasitic conductive element 210 and the first radiating conductive element 207 and between the parasitic conductive element 210 and the second sub-conductive piece 203 so that the electromagnetic radiating energy can be coupled to the parasitic conductive element 210 via the spacings to excite a resonant mode. Therefore, the multi-band antenna 200 further has a fourth resonant mode frequency of a high band, which is controlled by connecting the short conductive element 206 with the third open end 214 of the parasitic conductive element 210, having a length of a quarter of the wavelength.

Figure 3:
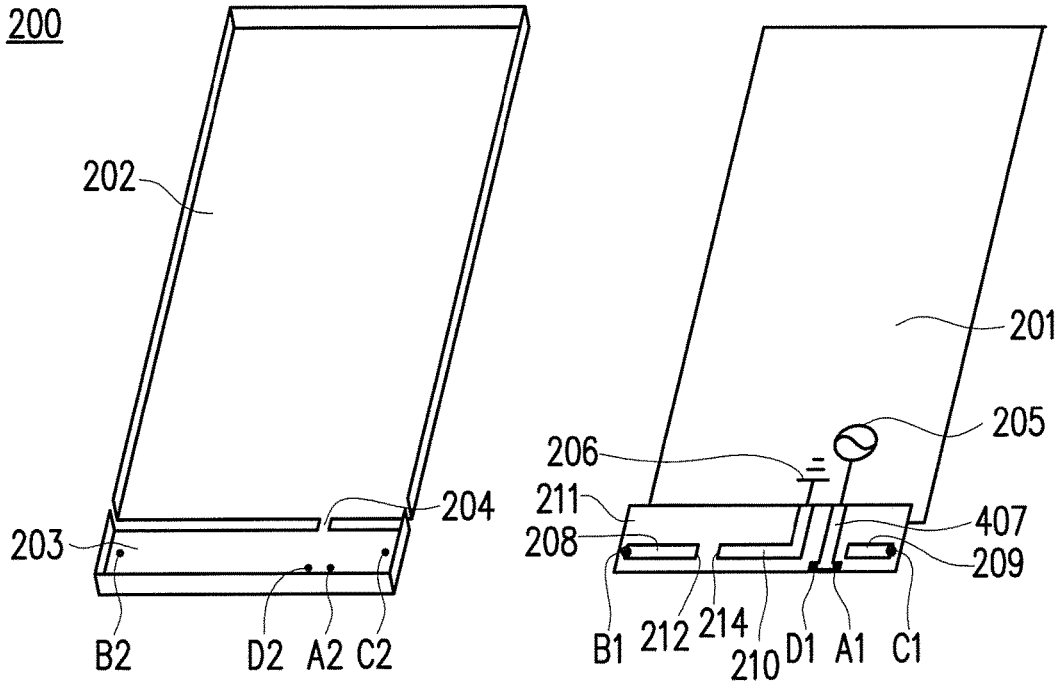
FIG. 3 is a schematic of another embodiment of the multi-band antenna in FIG. 1.

In the embodiment described above, the first radiating conductive element 207 is in a shape of a long strip and in the form of signal feed. In another embodiment, the first radiating conductive element 407 may also has a T shape and in the form of double feed, as shown in FIG. 3. The number of the feed point is increased when compared with the embodiment previously described, thus altered the bandwidth and efficiency of the multi-band antenna 400 (as shown in FIG. 4).

The multi-band antenna 400 shown in FIG. 3 has a first resonant mode frequency of a lower band, which is controlled by connecting the signal feed line 205 with the first radiating conductive element 407, connecting the electrical contact D1 on the left side of the first radiating conductive element 407 with the electrical contact D2 of the second sub-conductive piece 203 via the conductive piece 215, and connecting the electrical contact B2 of the sub-conductive piece 203 with the first opening end 212 of the second radiating conductive element 208 via another conductive piece 215, having a length of a quarter of the wavelength. The multi-band antenna 400 has a second resonant mode frequency of a middle band, which is controlled by connecting the signal feed line 205 with the first radiating conductive element 407, connecting the electrical contact A1 of the first radiating conductive element 407 with the electrical contact A2 of the second sub-conductive piece 203 via the conductive piece 215 which is a metal spring, and connecting the electrical contact C2 of the second sub-conductive piece 203 with the second open end 213 of the third radiating conductive element 209 via the conductive piece 215 and the electrical contact C1, having a length of a quarter of the wavelength. This multi-band antenna 400 has a third resonant mode frequency of a high band, which is controlled by connecting the signal feed line 205 with the first radiating conductive element 407, connecting the electrical contact D1 on the left side of the first radiating conductive element 407 with the electrical contact D2 of the second sub-conductive piece 203 via the conductive piece 215, and connecting the electrical contact B2 of the sub-conductive piece 203 with the first open end 212 of the second radiating conductive element 208 via the conductive piece 215 and the electrical contact B1, having a length of one half of the wavelength. Similar to the single-feed first radiating conductive element 207 having a strip shape, suitable spacings exist between the parasitic conductive element 210, the first radiating conductive element 407 and the second sub-conductive piece 203, so that the electromagnetic radiating energy can be coupled to the parasitic conductive element 210 via the spacings to excite a resonant mode. Therefore, the multi-band antenna 400 of the present embodiment also has a fourth resonant mode frequency of a high band, which is controlled by connecting the short conductive element 206 with the third open end 214 of the parasitic conductive element 210, having a length of a quarter of the wavelength. Compared with the embodiment mentioned above that the single-feed first radiating conductive element 207 has a shape of a strip, in this embodiment the return loss of each resonant mode of the multi-band antenna 400 with the dual-feed first radiating conductive element 407 having a T shape is lower.

Figure 4:
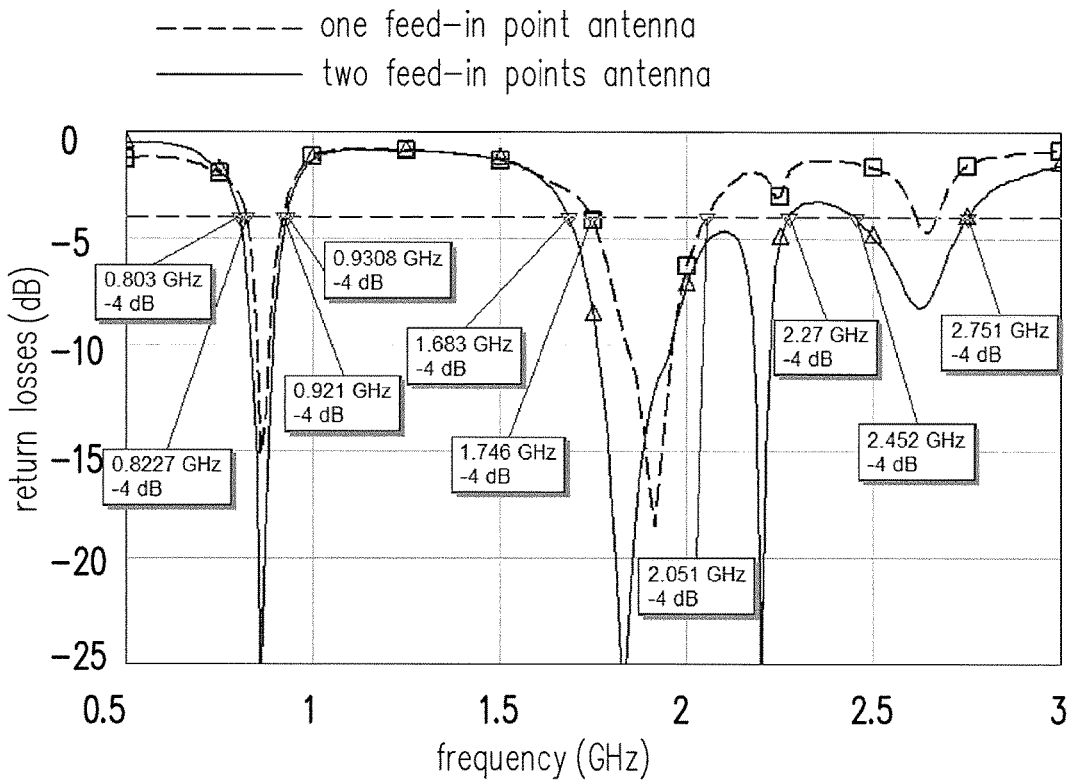
FIG. 4 is a schematic diagram comparing the frequencies and the return losses of the multi-band antennas of the two embodiments measured by Agilent E8357A network analyzer.

FIG. 4 is a schematic diagram comparing the frequencies and the return losses of the multi-band antenna 200 and the multi-band antenna 400 of the two embodiments mentioned above measured by Agilent E8357A network analyzer, wherein the input impedance bandwidth uses VSWR of 4.5:2 or the return loss of 4 db as a standard, while the impedance bandwidth of the operation frequency covers the bandwidth of LTEband7/C2K/EGPRS/UMTS systems. From FIG. 4 it can observed that in the multi-band antennas 200 and 400 of the embodiments of the invention, whether the first radiating conductive elements 207 and 407 provides one feed-in point or two feed-in points results in different resonant modes, such as the variations of the return loss, the frequency band and the bandwidth. Furthermore, the single-feed multi-band antenna 200 does not have a resonant mode with a higher frequency band as the multi-feed multi-band antenna 400.

Figure 5:
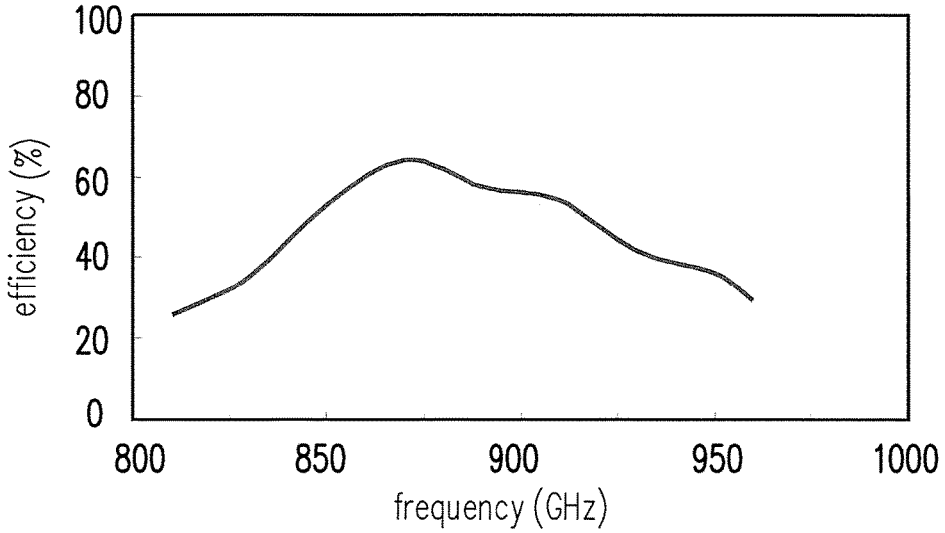
FIG. 5 is a diagram showing the efficiency of the low frequency band of the resonant mode of the multi-band antenna.
Figure 6:
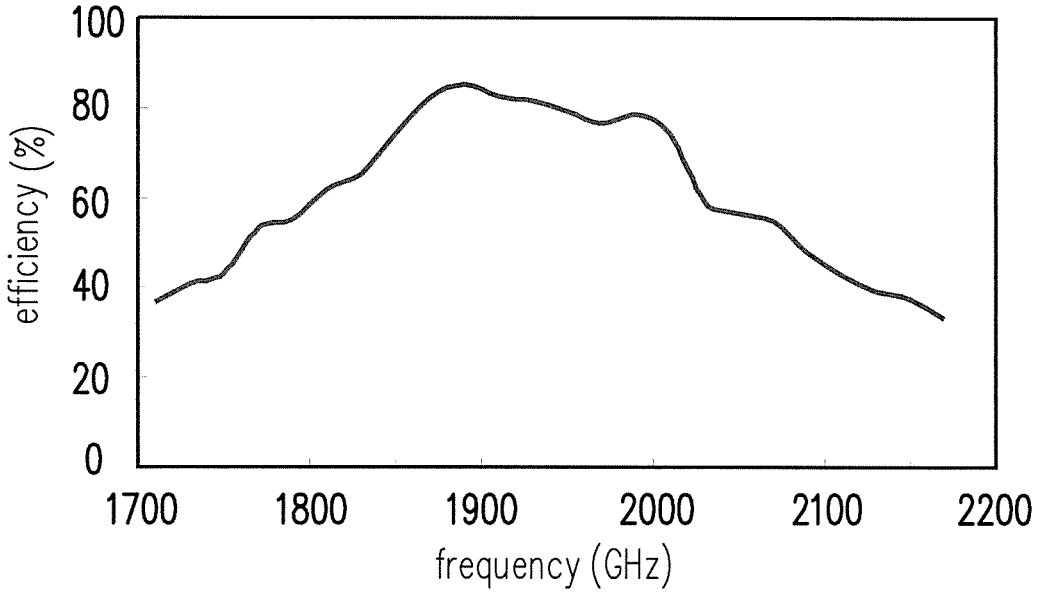
FIG. 6 is a diagram showing the efficiency of the intermediate frequency band of the resonant mode of the multi-band antenna.
Figure 7:
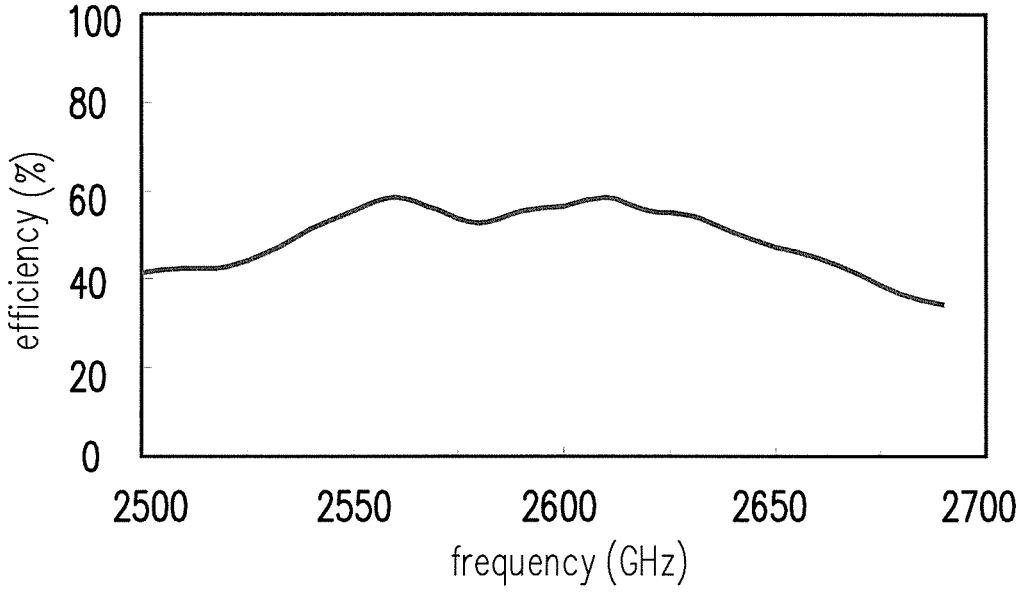
FIG. 7 is a diagram showing the efficiency of the high frequency band of the resonant mode of the multi-band antenna.

FIG. 5 is a diagram showing the efficiency of the low frequency band of the resonant mode of the multi-band antenna. From FIG. 5 it can be observed that the first resonant mode frequency is between 810~960 MHz with an efficiency between 25~65%. FIG. 6 is a diagram showing the efficiency of the intermediate frequency band of the resonant mode of the multi-band antenna. From FIG. 6 is can be observed that the second resonant mode frequency and the third resonant mode frequency of the multi-feed multi-band antenna 400 are between 1700~2200 MHz with frequencies between 30~86%. FIG. 7 is a diagram showing the efficiency of the high frequency band of the resonant mode of the multi-band antenna. From FIG. 7 is can be observed that the frequency of the high frequency band of the resonant mode is between 2500~2700 MHz and the efficiency is between 35~60%. Therefore, from FIG. 4 to FIG. 7, it can be observed that the first radiating conductive element 407 of a T shape increases the operating frequency band of the resonant mode since it provides more feed-in points.

To sum up, the multi-band antenna of the invention makes the radiating conductive element contact with the conductive cap physically via the conductive piece. Therefore, although a gap similar to a slot is formed, the resonant mode of the multi-band antenna is not excited via the slot. This not only solves the issue that the antenna signal is affected by the conductive back cover of the electronic device, but also makes the position of the conductive connecting portion be changeable in view of actual design requirements since the resonant mode of the multi-band antenna is not excited by the slot, which solves the issue of the appearance design of the electronic device.

Furthermore, the conductive cap can be made by cutting a conductive plate (such as a metal plate). In other words, the first sub-conductive piece, the second sub-conductive piece and the conductive connecting portion are integrally formed. Compared with the conductive cap that the two sub-conductive pieces are combined by glues or other means, the conductive cap of the multi-band antenna of the invention has the advantages of a more solid structure and a lower manufacturing cost.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A multi-band antenna, comprising:

a conductive cap having a first sub-conductive piece, a second sub-conductive piece and a conductive connecting portion connected between the first sub-conductive piece and the second sub-conductive piece, the first sub-conductive piece being at a distance from the second sub-conductive piece to form a gap at least at one side of the conductive connecting portion;

a ground plane element having a signal feed line;

a supporting frame, the ground plane element being disposed between the supporting frame and the conductive cap;

a first radiating conductive element, a second radiating conductive element and a third radiating conductive element disposed at the supporting frame, wherein the first radiating conductive element is disposed between the second radiating conductive element and the third radiating conductive element, and both the second radiating conductive element and the third radiating conductive element are not extending from the first radiating conductive element; and a plurality of conductive pieces, wherein the first radiating conductive element, the second radiating conductive element and the third radiating conductive element have electrical contacts connected with the conductive cap via one of the conductive pieces, respectively, and another electrical contact of the first radiating conductive element is connected with the signal feed line.

2. The multi-band antenna according to claim 1, wherein the conductive cap is an outer cover of an electronic device.

3. The multi-band antenna according to claim 1, wherein the material of the conductive cap is metal or carbon fiber.

4. The multi-band antenna according to claim 1, wherein the supporting frame is made of non-conductive material.

5. The multi-band antenna according to claim 1, wherein the dielectric coefficient of the supporting frame is at least different from the dielectric coefficient of one of the first radiating conductive element, the second radiating conductive element and the third radiating conductive element.

6. The multi-band antenna according to claim 1, wherein the conductive pieces are metal spring plates.

7. The multi-band antenna according to claim 1, wherein the second radiating conductive element and the third radiating conductive element are disposed within the orthographic projection area of the second sub-conductive piece.

8. The multi-band antenna according to claim 1, further comprising:

a parasitic conductive element disposed on the supporting frame and between the second radiating conductive element and the first radiating conductive element, the ground plane element further having a short conductive element, and the parasitic conductive element being connected with the short conductive element.

9. The multi-band antenna according to claim 8, wherein the ground plane element does not have a slot and the multi-band antenna excites a resonant mode via spacings existing between the parasitic conductive element and the first radiating conductive element and between the parasitic conductive element and the second sub-conductive piece.

* * * * *